US005839912A

United States Patent [19]

Schekalla et al.

[11] Patent Number: 5,839,912

[45] Date of Patent: Nov. 24, 1998

[54] ELECTRICAL PLUG-AND-SOCKET CONNECTION

[75] Inventors: Peter Schekalla; Roman Seutschniker, both of Wuppertal, Germany

[73] Assignee: Delphi Automotive Systems Deutschland GmbH, Wuppertal, Germany

[21] Appl. No.: 676,274

[22] PCT Filed: Nov. 18, 1995

[86] PCT No.: PCT/DE95/01607

§ 371 Date: Jul. 3, 1996

§ 102(e) Date: Jul. 3, 1996

[87] PCT Pub. No.: WO96/18202

PCT Pub. Date: Jun. 13, 1996

[30] Foreign Application Priority Data

Dec. 6, 1994 [DE] Germany ..... 44 43 349.2

[51] Int. Cl.[6] ..... H01R 13/62

[52] U.S. Cl. ..... 439/157

[58] Field of Search ..... 439/152–160

[56] References Cited

FOREIGN PATENT DOCUMENTS 0501502 of 1992 European Pat. Off. .

3730020 of 1988 Germany .

8914038 of 1990 Germany .

4129236 of 1993 Germany .

4228531 of 1993 Germany .

*Primary Examiner*—Gary F. Paumen

*Attorney, Agent, or Firm*—Cary W. Brooks

[57] ABSTRACT

The invention relates to an electrical plug-and-socket connection comprising two detachable connecting parts, which, by means of a laterally extensible slide, both can be axially coupled together and decoupled. The one connecting part comprises a socket housing having control means. The other connecting part comprises a complementary plug housing having a laterally protruding coupling journal. The slide possesses a profiled coupling channel. In order to achieve a space-saving construction of the plug-and-socket connection, it is proposed to provide two different control means between the slide and the socket housing. The first control means is an axial control mechanism having an essentially linear groove in the socket housing and a radial bearing cam on the slide, which simultaneously determines the pivot bearing for a pivot motion of the slide. The second control means is a tilt control mechanism having, on the one hand, a sliding block and, on the other hand, a sliding block guide, which latter is curved according to the combined pivot-translation motion of the slide.

10 Claims, 6 Drawing Sheets

FIG. 9
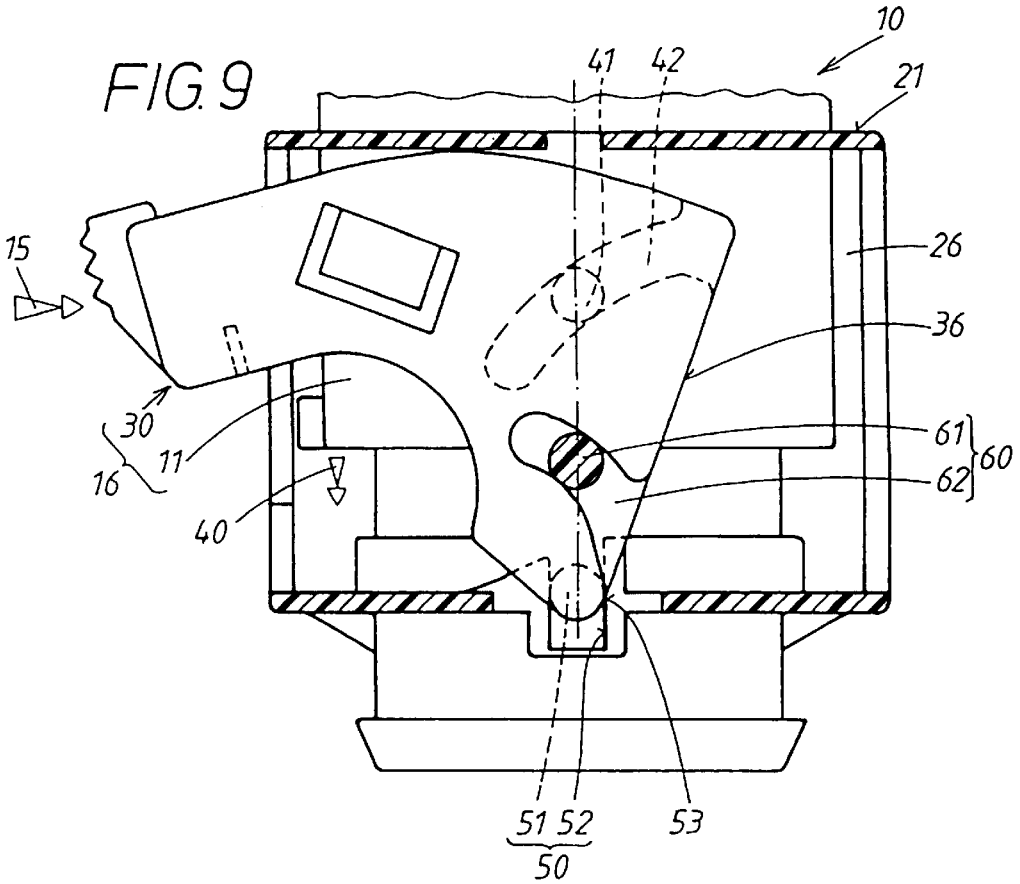
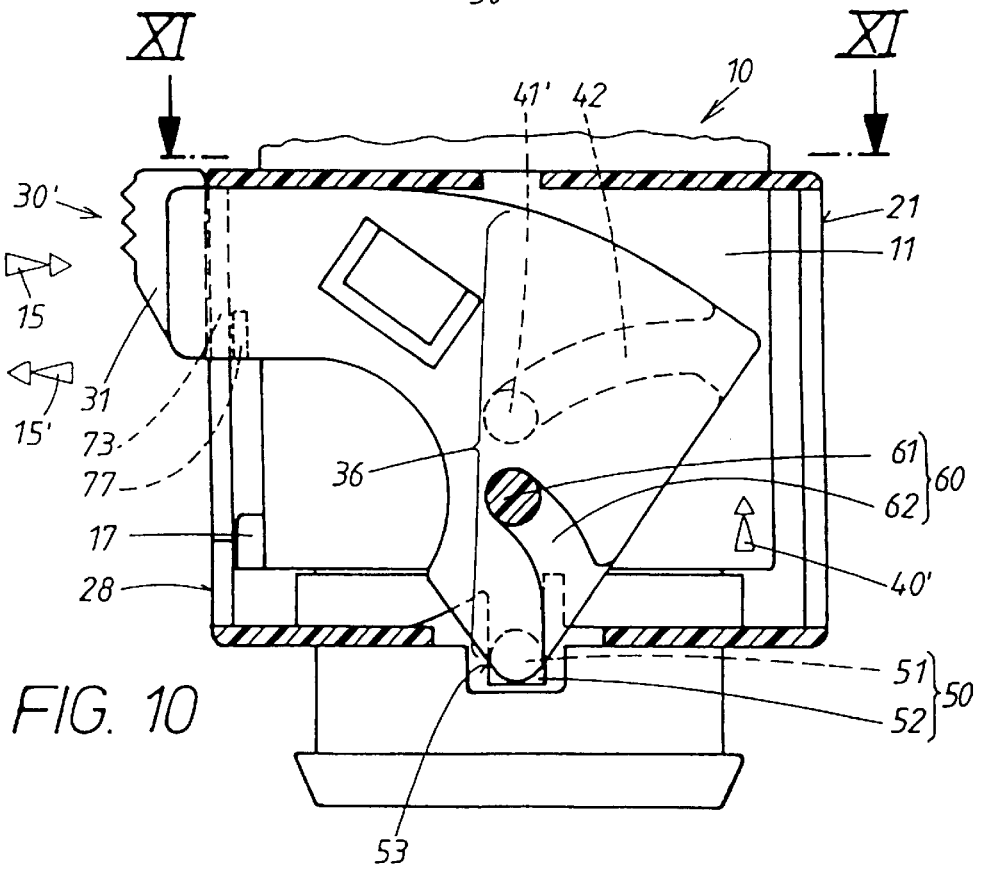
FIG. 10

ELECTRICAL PLUG-AND-SOCKET CONNECTION

FIELD OF THE INVENTION

The invention relates to an electrical plug-and-socket connection.

BACKGROUND OF THE INVENTION

In the known plug-and-socket connection of this type, the control means between the slide and the housing in which it is received consist in the slide being configured as a cradle, which is guided in a transversely displaceable manner in rails in the housing running transversely to the coupling axis. The coupling channel provided in the slide has an angled-off course and the axial height of this angular course determines the axial stroke by which, in the coupling situation, the two connecting parts are drawn one into the other under the transverse motion of the slide. In order to guide the housings of the two connecting parts deeply one into the other during the coupling operation and, at the same time, to bring into engagement the electrical contacts and mating contacts which are located there, the maximum possible axial stroke height is necessary. In order however to obtain a large axial stroke height, in the known plug-and-socket connection the clearance between the channel entrance and the channel end of the angled-off coupling channel in the slide had to be dimensioned correspondingly large. Both the slide and the housing in which it is received are thereby required to have a large structural height.

If, in the known plug-and-socket connection, a large axial stroke is desired, by movement of the slide, in the coupling and decoupling of the two connecting parts, then the climb from the angled-off coupling channel of the slide must not be too steep, since the slide otherwise becomes stiff to actuate. For a flat angular course of the coupling channel, a large transverse displacement distance of the slide in the housing is obtained however in return. The slide therefore, in its extended release setting, juts correspondingly far out of the housing. For the actuation of the slide, a correspondingly large lateral space is then required next to the connecting part in which the slide is received. Particularly in the use of plug-and-socket connections in the automotive field, this space is not always available, so that it has been necessary to make do with plug-and-socket connections having a small axial stroke.

In an electrical plug-and-socket connection of a different type (EP 0 501 502 A2), it is known to use for the coupling and decoupling operations, in place of a laterally extensible slide, a disk which is rotary-mounted on the housing of the one connecting part and which possesses two S-shaped channels which are diametrically opposed relative to their rotation journal. The one S-shaped channel serves as a coupling channel for the coupling journal of the other connecting part, while the second S-shaped channel interacts, as a control channel, with a control pin located on the housing of the first connecting part. As a result of the second control channel and the control pin, the rotary disk is moved with its rotation journal in an axial housing groove. The diameter of the rotary disk is determined by the sum of the axial height of the two diametric channels. A relatively large structural height of the rotary disk and of the housing in which it is rotary-mounted is therefore obtained. Furthermore, the rotary disk is made harder to manipulate, since it bears constantly with its inner face against the one outer side of the housing, while its outer face has a rib which is diametric to the rotary actuation of said rotary disk. The diametric rib can only be manually grasped in the journal region of the rotary disk, whereby only a relatively small rotation force may to be exerted. A small actuating force maybe to exert only correspondingly small coupling forces between the two connecting parts. Furthermore, the rotary disk cannot be brought into a laterally extended release setting in relation to the housing and nor, consequently, can it be retracted into the housing, like a slide, at high thrust.

In a further detachable plug-and-socket connection of different type (DE-41 29 236 A1), it is known to mount a locking lever in fixed position on the plug housing of the one connecting part and to provide on the socket housing a projection which, in the manual coupling of the two connecting parts, travels through an axial opening into a transversely running coupling channel of the socket housing. When the locking lever is pivoted, the projection travels into the coupling channel and, by means of its fixed pivot bearing, forces the plug housing axially into the socket housing. In the coupling position, the two connecting parts are secured against being axially pulled out. The rotary path of the locking lever is relatively large and amounts to a quadrant to enable it to be transferred—in relation to the two connecting parts—out of a radial position prior to coupling into an axial position following coupling. This calls for a large amount of space in the area surrounding the connecting parts. A large axial stroke between the two connecting parts requires a large clearance between the projection and the pivot bearing of the locking lever and a correspondingly long length of the transverse slot. The adverse consequence of this is that the two housings of this plug-and-socket connection are large in dimension.

In a known plug-and-socket connection (DE 42 28 531 A1), it is known to mount a slide in fixed position on the socket housing and to equip it with a sliding block guide for a coupling journal provided on the plug housing. The same coupling journal engages in an axial coupling channel of the socket housing. The slide is configured in the shape of a U-bow and has a tongue-shaped latch fastening for the slide, which latch fastening is formed by a cutout in the leg of the U-bow of the slide. The slide possesses, at least on one of the two bow legs, a latch element for the latch fastening. In this plug-and-socket connection, too, only a small axial stroke is able to be achieved in the coupling and decoupling of the two connecting parts.

SUMMARY OF THE INVENTION

This plug-and-socket connection of the present invention comprises two connecting parts, which can be axially coupled or decoupled with the aid of a laterally movable slide. The slide facilitates the axial joining-together and detachment of the two connecting parts. The slide is guided in the housing of the one connecting part by control means and possesses a profiled coupling channel into and from which a coupling journal protruding laterally from the housing of the other connecting part can be axially inserted and withdrawn in a first setting of the slide. An extended release setting of the slide relative to the housing of the connecting part in which it is then established. The slide can also however, be moved by the control means into another setting, in which the coupling journal located in the coupling channel is axially overlapped by wall parts. A lock setting of the slide is then established, in which the coupling position of the two connecting parts is secured.

The object of the invention is to develop an inexpensive plug-and-socket connection, which, both in terms of the two housings of the connecting parts and in terms of the lateral motion of the slide relative to the housing in which it is received, has small dimensions and yet delivers a large axial stroke of the connecting parts in the coupling and decoupling operations and, at the same time, can be smoothly actuated.

As it moves within the socket housing, the slide performs a translatory pivot motion in the socket housing, for which it possesses two different control means. The first control means is an axial control mechanism having a linear axial groove on the socket housing and a radial bearing cam on the slide, which perform a translation motion relative to each other, yet at the same time generate at their contact point a translationally movable pivot bearing point for the slide. This pivot bearing point serves the other control means, which forms a tilt control mechanism and which incorporates, on the one hand, a sliding block and, on the other hand, a sliding block guide. This sliding block guide has a curvature corresponding to the combined pivot-translation motion. It is thereby possible to pivot the slide into a laterally extended release setting in relation to the socket housing, in which the coupling journal can be inserted into and withdrawn from the open end of the coupling channel of the slide. In this laterally extended release setting, the slide offers a good working surface for its manual actuation. The slide thereupon performs a translatory pivot motion and, in the coupling and decoupling operations, transports the plug housing as a result of the engagement of the coupling journal in the coupling channel on the slide side.

The coupling channel of the slide is designed as an arc segment, which advantageously is determined solely by the pivot motion of the slide. For a high axial stroke in the coupling and decoupling operations between the two connecting parts, it is sufficient to pivot the slide by a relatively small angle, which is less, for example, than an octant. A small pivot angle ensures that the slide, in its pivoted-out release setting, protrudes relatively little from the socket housing, which needs to have a correspondingly small construction width. Yet also the axial length of the socket housing is able to be made relatively small, since the arc segment which is formed by the coupling channel is located, in relation to the aforementioned pivot bearing of the slide, on the same lever side as the tilt control mechanism of this slide. The slide therefore has the relatively small axial dimension of a one-armed lever, the lever arm length of which is determined by the clearance between its pivot bearing on the bearing cam, on the one hand, and the open end of the arc-shaped coupling channel, on the other hand. The slide-side control part of the tilt control mechanism is situated therebetween. The socket housing consequently requires only a relatively small axial dimension, which derives from the lever arm length of the slide minus the translatory motion of its pivot bearing. As a result of this arrangement of the coupling and control means, favorable force relationships according to the lever principle are also obtained in the actuation of the slide. In the coupling and decoupling of the two connecting parts, a large axial stroke is nevertheless achieved, since the arc height of the coupling channel is required to deliver only a part-stroke for this purpose, while the residual stroke is attended to by the translation motion of the slide in the socket in the socket housing. Since the coupling channel, in its arc segment, needs only take account of a part-stroke of the axial coupling motion, it has a relatively small pitch, which produces a smooth guidance of the coupling journal. The pivot-movable slide forms together with the plug housing, which engages by its coupling journal into the arc segment of the slide, a unit which moves in joint translatory motion whenever the slide is pivoted.

In fitting the slide in the socket housing, an assembly force is applied, which lies substantially, e.g. 30%, above the actuating force which is subsequently necessary to actuate the slide.

BRIEF DESCRIPTION OF THE DRAWINGS

Further measures and advantages of the invention derive from the subclaims, the following description and the drawings. The invention is represented in an illustrative embodiment in the drawings, in which:

FIG. 9 shows, in a side view cut according to FIG. 7, the two connecting parts, the slide having been moved onward from its release setting in FIG. 7;

FIG. 10 shows, in a representation corresponding to FIG. 7, the definitive coupling position of the two connecting parts after the slide has transferred into its other position which determines the "lock setting" and is represented also in FIG. 7 in dotted representation;

DETAILED DESCRIPTION

Figure 4:
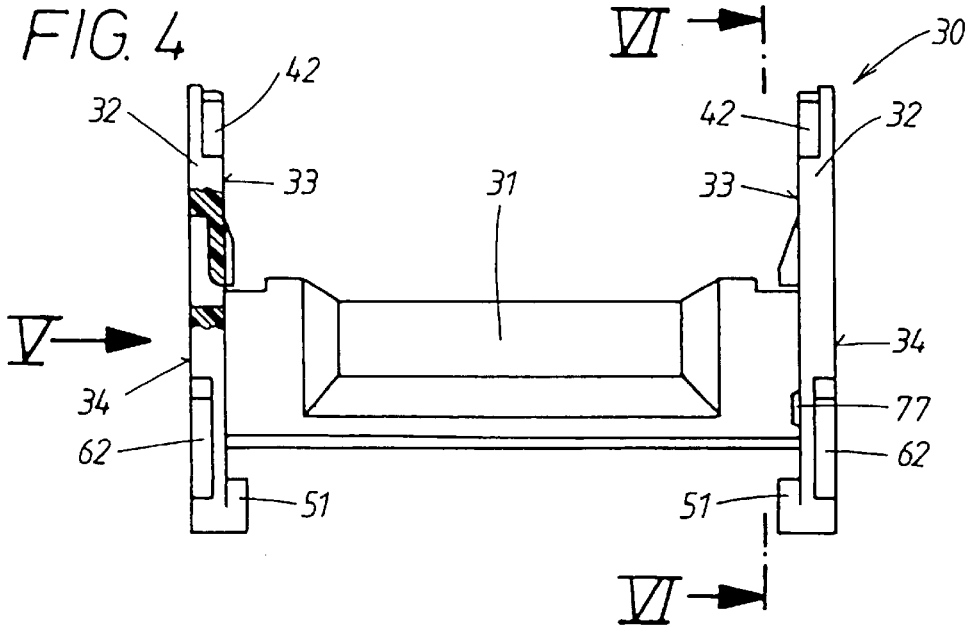
FIG. 4 shows the inner view of a U-shaped slide belonging to the socket housing of the relay carrier of FIG. 1, having at one place an aperture.
Figure 5:
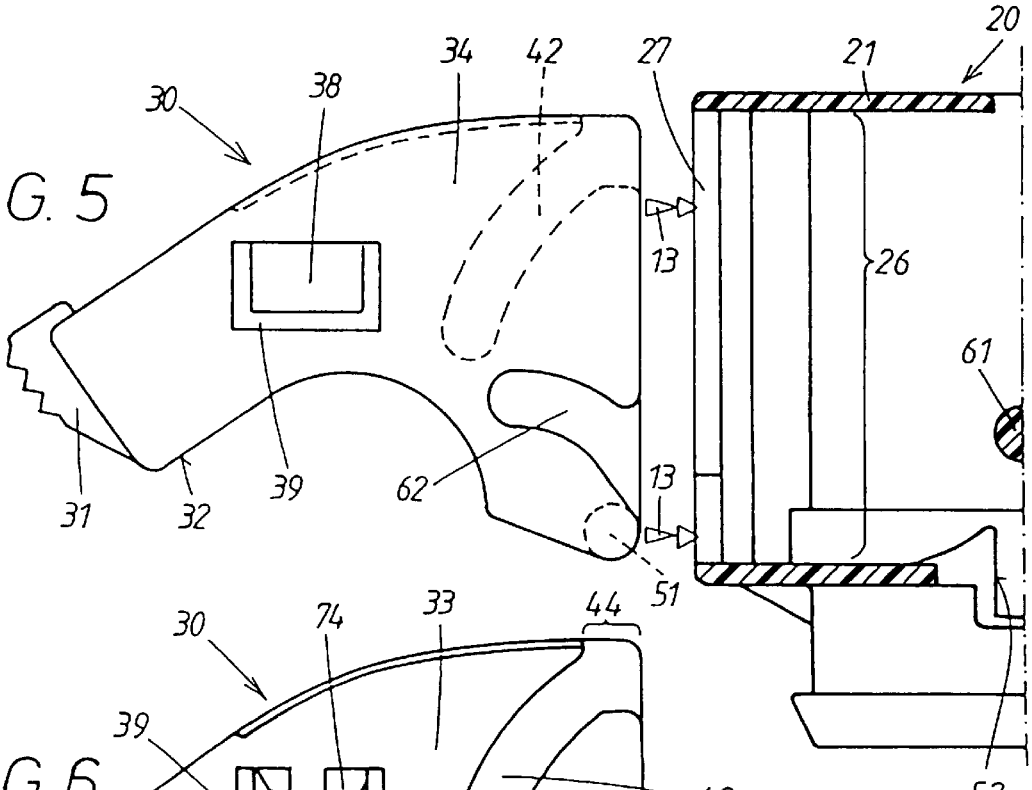
FIG. 5 shows a side view of the slide, in the direction of view V of FIG. 4, prior to its insertion into a lateral receiving fixture of the socket housing of the relay carrier, which socket housing is shown in the axis-parallel section along the sectional line V—V of FIG. 2.
Figure 6:
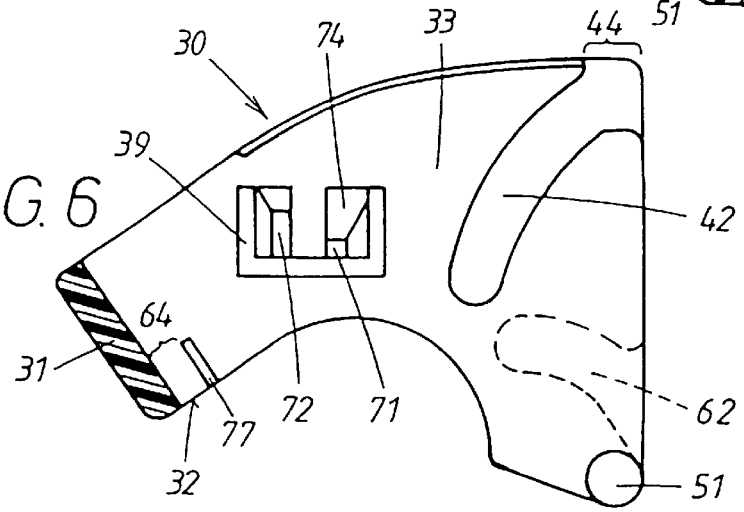
FIG. 6 shows a lateral sectional view through the slide of FIG. 4 along the sectional line VI—VI which is present there.

In the represented illustrative embodiment, the two connecting parts 10, 20 of the plug-and-socket connection shown in the figures comprise a relay 10 and a relay carrier 20, which further incorporates a slide 30 according to FIGS. 4 to 6. The slide 30 serves to perform the coupling motion, portrayed by the arrow 40 in FIG. 7, between the relay 10 and the relay carrier 20, and the decoupling motion portrayed by the corresponding counter-arrow 40' in FIG. 10.

Figure 1:
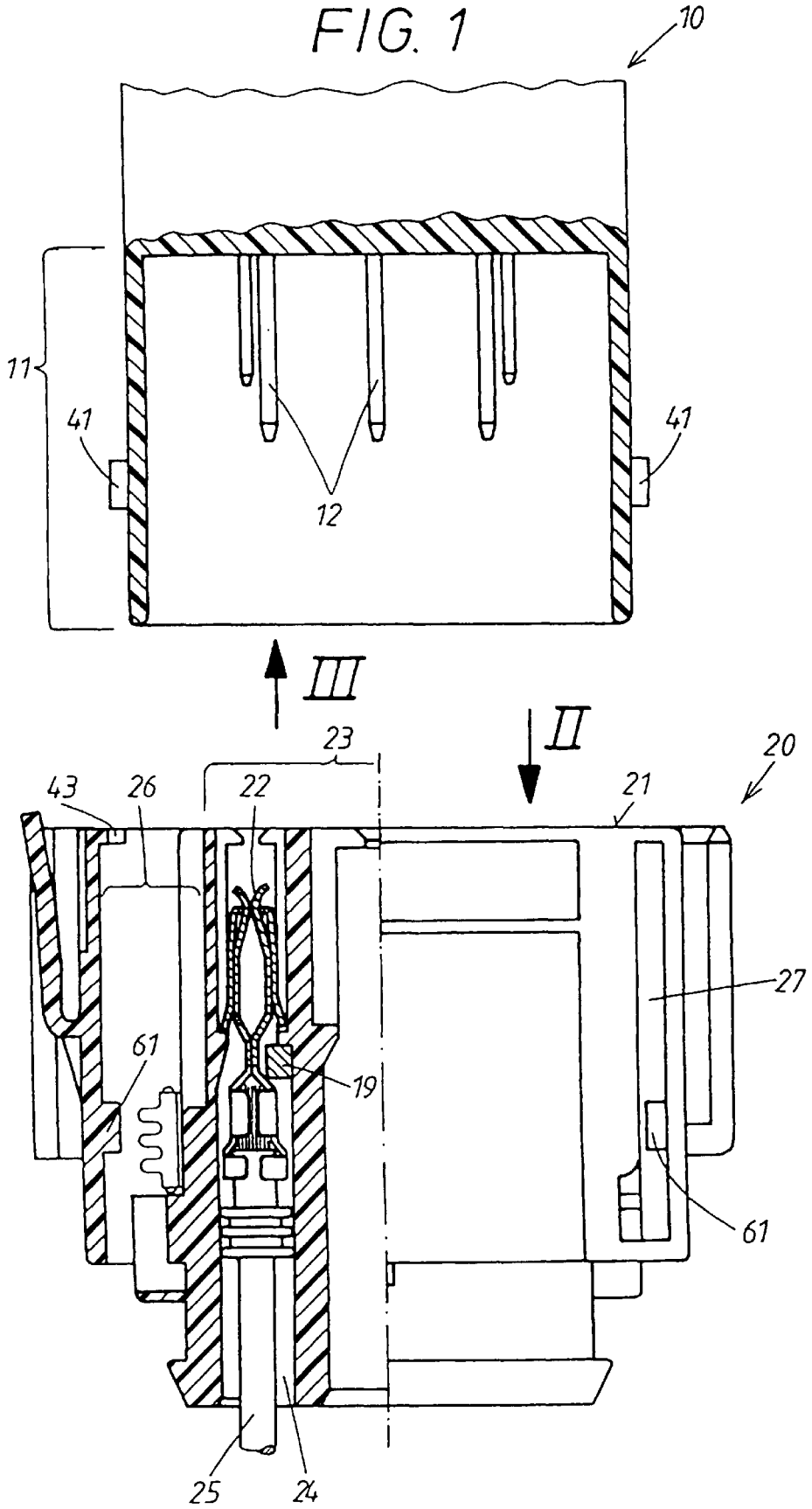
FIG. 1 shows, in decoupled, axially aligned position, in the top diagram, with a wall aperture, the lower end of a first connecting part, configured as a relay, of a plug-and-socket connection, and, in the bottom diagram, in an axial half-section, the other connecting part, configured as a relay carrier, a slide having been removed from the socket housing belonging to the relay carrier.
Figure 2:
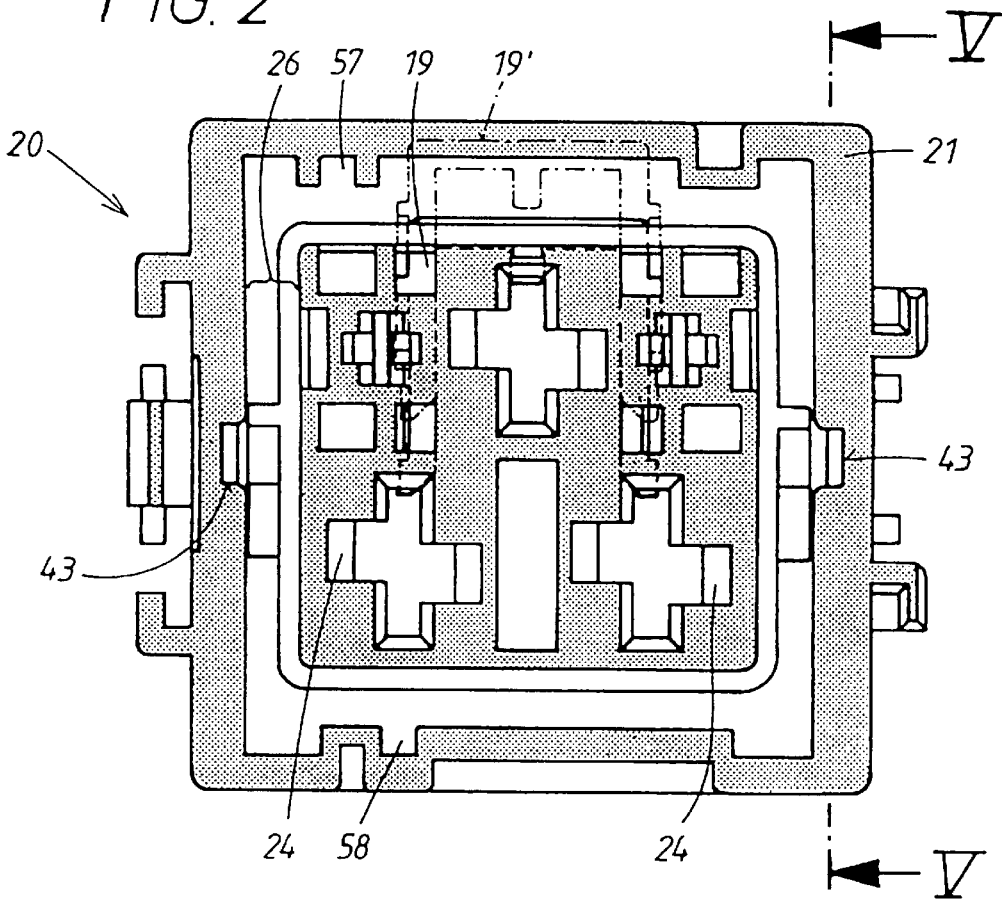
FIG. 2 shows, in the direction of view II of FIG. 1, the relay carrier in axial top view, the slide here too not yet being fitted in the socket housing.

The relay carrier 20 possesses a socket housing 21, which has a core piece 23 containing numerous axial chambers 24 discernible from FIGS. 1 and 2. The axial chambers serve the reception of electrical contacts, which are latch-locked there and are captively locked in place by a so-called "comb" 19. FIG. 2 depicts in dash-dot representation a preliminary latch setting 19' of the comb 19, in which the contact parts 22 crimped on the conductors of electric leads 25 are able to be inserted into the axial chambers 24 before being locked there in the pulled-out end latch setting of FIGS. 1 and 2 of the comb 19. As can best be discerned from the front view of FIG. 2, in which the two end faces, lying in one plane, of the outer encasement of the socket housing 21 and of the core piece 23 are highlighted by dotted shading, the socket housing possesses an angularly configured receiving fixture 26, into which both housing parts of the relay 10 and parts of the slide 30 are inserted.

Figure 3:
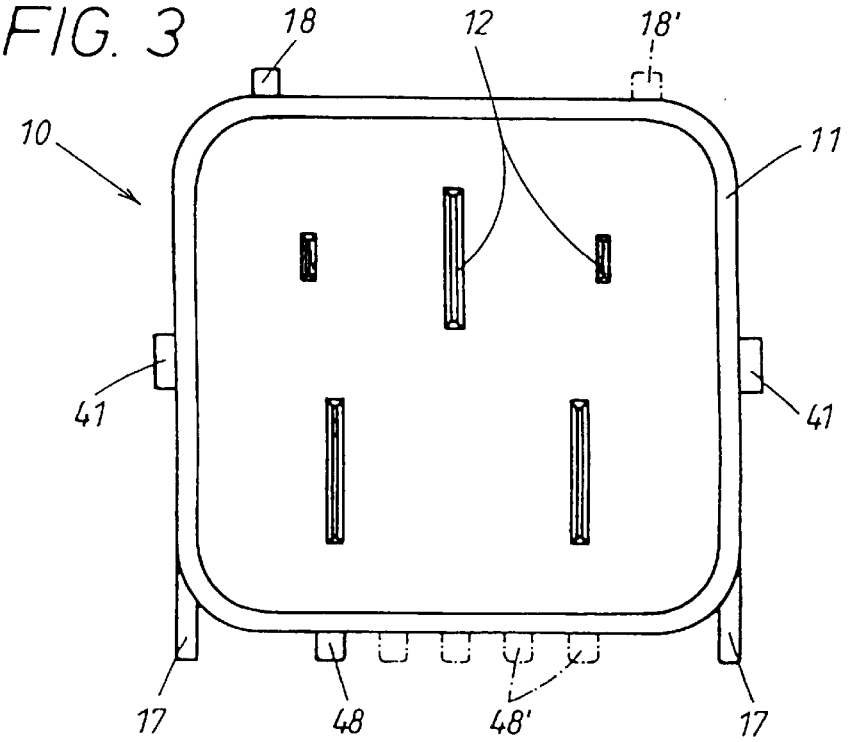
FIG. 3 shows, in the direction of view indicated by III in FIG. 1, the end view of the relay.

The relay 10 possesses a plug housing 11, which is designed according to the receiving fixture 26 of the socket housing 21 and which is of sleeve-shaped configuration and has a plurality of electrical mating contacts 12 inside the sleeve. Of course, the mating contacts 12 are positioned in the plug housing 11 in an arrangement pattern which, as FIG. 3 shows, corresponds to the position of the aforementioned contacts 22 in the socket housing 21. The plug housing 11 possesses, on two diametrically opposing outer faces, a coupling journal 41 for the aforementioned coupling and decoupling motions 40,40'. According to the position of the coupling journal 41, the socket housing 21 possesses an axial insert opening 43, which can be seen from FIGS. 1 and 2, for the coupling journal 41 at its front end. The two associated coupling channels 42, on the other hand, are located in the slide 30, which has the following construction.

The slide 30 is configured as a U-shaped bow, which, for its tilt actuation which is yet to be more closely described, firstly has a crown bar 31, which is best discernible in the section of FIG. 6 and at whose bar ends are seated, at right angles, two bow legs 32 of essentially planar configuration. The aforementioned two coupling channels 42 are disposed respectively on the mutually facing inner faces 33 of the two bow legs 32. At the inner end of the two bow legs 32 there is respectively located a bearing cam 51 of an axial control mechanism 50 yet to be more closely described. The bearing cam 51 likewise protrudes from the inner face 33 of the leg according to FIG. 4. On the two outer faces 34 of the bow legs 32 there is located, on the other hand, a sliding block guide 62 of a tilt control mechanism 60 yet to be more closely described.

Figure 7:
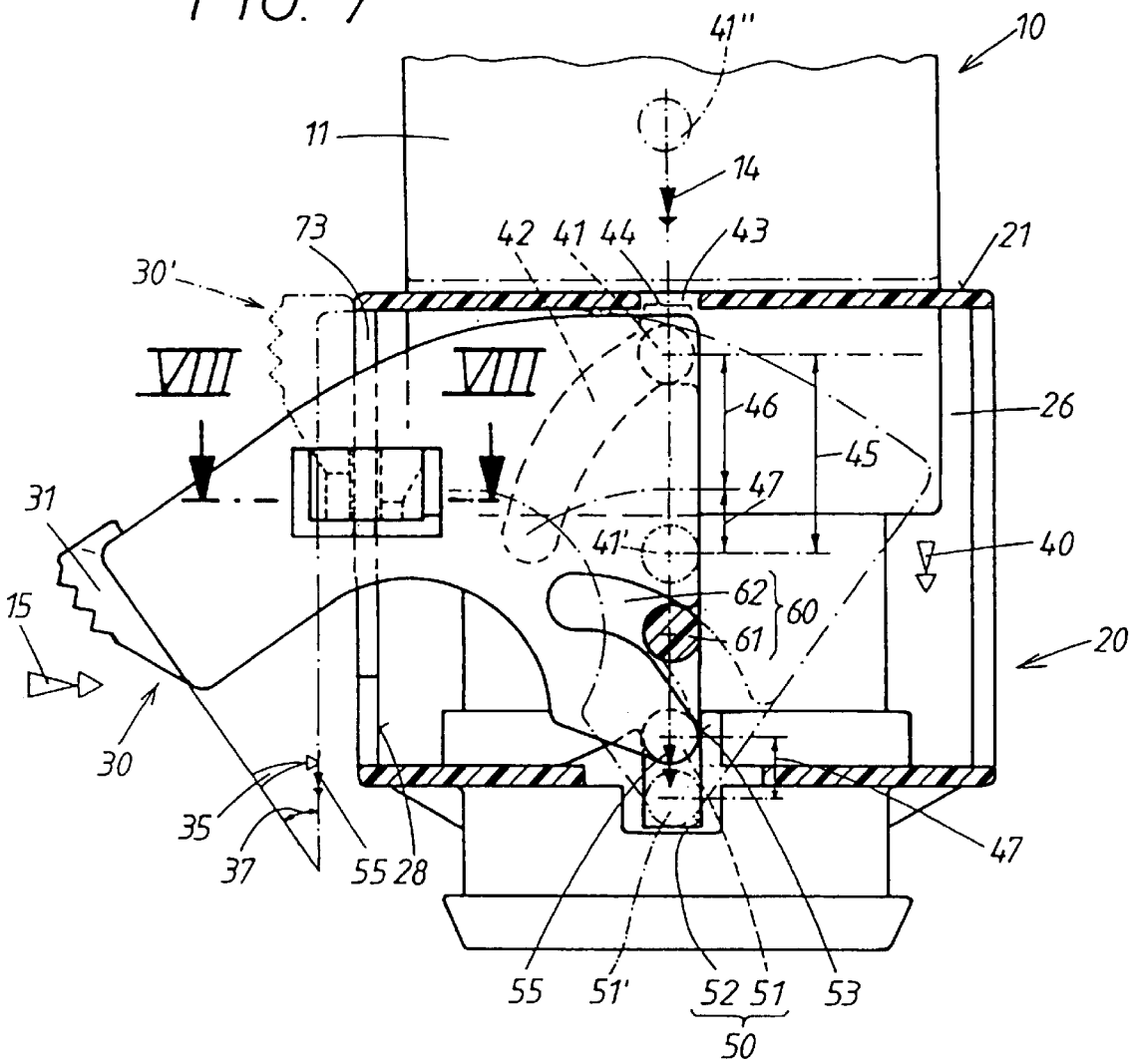
FIG. 7 shows, in a side view corresponding to FIG. 5, a so-called "release setting" of the slide, the slide having been inserted into the socket housing through a lateral opening and having been fitted there beforehand and the relay being in a starting setting as coupling takes place.

The slide 30 is plugged through a lateral inlet opening 27, discernible from FIG. 1, into the receiving fixture of the socket housing 21, in the direction of the insertion arrows 13 visible in FIG. 5, until finally, via an ascending ramp, the described bearing cam 51 snaps in place into an essentially linear axial groove 52 in the socket housing 21. Inside the receiving fixture 26, the socket housing 21 possesses a further positionally fixed sliding block 61, which, upon this insertion 13, travels into the mouth, which is assigned to it, of the sliding block guide 62 located in the slide 30. This finally leads to the starting setting of the slide 30 in the socket housing 21. This starting setting is shown in FIG. 7. This starting setting of the slide 30 is fixed by a latch fastening 70, which is yet to be more closely described with reference to FIG. 8.

In this starting setting, the coupling channel 42 is aligned by a free channel opening 44, which can best be seen from FIG. 6, with the previously described insert opening 43 in the housing 21. This enables the coupling journal 41 located on the plug housing 11 to be inserted there axially, in the direction of the insertion arrow 14, into its starting position visible in FIG. 7. In FIG. 7, an axially higher position 41" of the coupling journal is also illustrated in dash-dot representation, from which the plug housing 11 is axially inserted into the front end of the receiving fixture 26. Owing to the free axial insertion 14 of the coupling journal 41 into the channel opening 44 and the corresponding pull-out motion running counter to the plug-in situation 14, this starting setting of the slide 30 shall hereinafter be described in short as the "release setting".

Starting from the release setting shown in FIG. 7, the slide 30 can be pivot-moved in translatory motion in a particular manner relative to the housing 21, whereby the slide can ultimately be transferred into the other end setting 30', which is visible in FIG. 10 and which shall hereinafter be abbreviated, for reasons which shall yet become clearer, to the "lock setting". This lock setting 30' is also depicted in FIG. 7 in dotted representation. The combined motion of the slide between the two settings 30, 30' of FIG. 7 is composed, as is illustrated there by arrows, of a pivot motion 35 and an axial translation motion 55.

The coupling channel 42 expediently takes into account only that motional component which is brought about by the pivot motion 35, and is therefore configured as an essentially circular arc segment 42. In a number of applications, an axial motional component could also even be added thereto. By contrast, the sliding block guide 62, according to the combined motional sequence made up of the pivot motion 35 on the one hand and the translation motion 55 on the other hand, is of curved configuration. As has already been mentioned, the sliding block guide 62 is disposed in the slide 30, while the associated sliding block 61 is disposed in fixed position in the receiving fixture 26 of the socket housing 21. It would also however be possible to dispose these two elements 61, 62 of the tilt control mechanism 60 inversely between the slide 30 and the socket housing 21.

In order to transfer the slide 30 from its release setting of FIG. 7 into the lock setting 30' of FIG. 10, a thrust (force) 15, which is illustrated in FIG. 7 by the arrow 15, is applied by hand to the crown bar 31 of the slide 30. As can be seen from the intermediate position which is discernible in FIG. 9, this crown bar 31 therefore approaches the socket housing 21. The coupling journal 21 located on the plug housing 11 thereupon slides inside the coupling channel 42 and forms together with the slide 30 a jointly movable unit 16. Between the peripheral faces of the plug housing 11 and the inner faces of the receiving fixture 26 in the socket housing 21, an axial guidance is obtained.

This unit 16 is forcibly guided however by the described tilt control mechanism 60. The tilt control mechanism 60 allows not only the pivot motion 35 mentioned in FIG. 7, which has partially been realized in FIG. 9, but imposes upon the unit 16 also a corresponding share of the translation motion 55. As revealed by a comparison between FIGS. 7 and 9, the bearing cam 51 has moved downwards in FIG. 9 axially within its groove 52. The coupling motion 40 between the two housings 11, 21 has therefore come about not only out of the circular curvature of the coupling channel 42, but also as a result of the axial component determined in the tilt control mechanism 60. The slide 30 has consequently tilted somewhat, whereupon its bearing cam 51 forms, at its point of contact with the axial groove 52, the determinant pivot bearing 53 for the previously described pivot motion 35. This pivot bearing 53 moves axially in the groove 42. It is significant that the tilt control mechanism 60 is located in relation to this pivot bearing 51 on the same side as the coupling channel 42 with the coupling journal 41 engaged within it. Both elements 41, 42 and 60 are situated on the same lever arm 36, which is indicated in FIG. 9. The tilt control mechanism 60 is here disposed closer to the pivot bearing 53 determined by the contact of the bearing cam 51 in the axial groove 53 than is the coupling channel 52.

In the lock setting of FIG. 10, the slide is forced laterally with its crown bar 31 against the socket housing 21 and thereby ends the effect of the thrust 15. The coupling journal 41 is located at the inner, closed end of the coupling channel 42 and is therefore axially covered by the channel wall of the coupling channel 42. A locking of the relay 10 in the relay carrier 20 is therefore established. The sliding block 61 has also reached the end of its sliding block guide 62 and has guided the bearing cam 51 into its axially lowest position in the groove 52. The two housings 11, 21 are brought into their axial, fully realized coupling setting in FIG. 10, whereby their contacts 22 and mating contacts 12, illustrated in FIG. 1, are maximally engaged.

Despite a relatively small structural height of the slide, which structural height is portrayed by its cams of the lever arm 36 illustrated in FIG. 10, and despite just a small pivot angle 37, discernible from FIG. 7, which can measure about 35°, a large axial stroke 45, illustrated by the arrow 45 in FIG. 7, has materialized in the coupling operation 40. This axial stroke 45 is composed of two components 46, 47. The pure pivot motion 35 generates an axial part-stroke 46 between the coupling journals 41, which is determined by the axial arc height of the coupling channel 42 in the slide 30. If, in fact, the translation motion 55 is initially disregarded, then the coupling journal 41 would move by the distance covered by this part-stroke 46 in FIG. 7.

As is illustrated in dotted representation in FIG. 7, in the lock setting of FIG. 10 the coupling journal makes its way however into the end position 41', which is illustrated in dotted representation in FIG. 7 and which determines the total axial stroke 45. This lower coupling position 41' is obtained because, by virtue of the forced guidance of the tilt control mechanism 60, the aforementioned translation motion 55 is still taking place which, in FIG. 7, is illustrated by the bearing cams 51 and 51' depicted in dashed and dotted representation respectively. This translation motion gives rise to a residual stroke 47, which is added to the aforementioned part-stroke 46. A larger axial stroke 45 is reached than might be expected on the basis of the small pivot angle 37 and the arc course of the coupling channel 42. The arc course of the coupling channel 42 is relatively flat and the midpoint of curvature lies far more distant than that corresponding to the length of the lever arm 36 in the slide 30, which length is determined by the pivot bearing 53. The result is that the coupling journal 41 is able to travel smoothly into the coupling channel 42.

Figure 8:
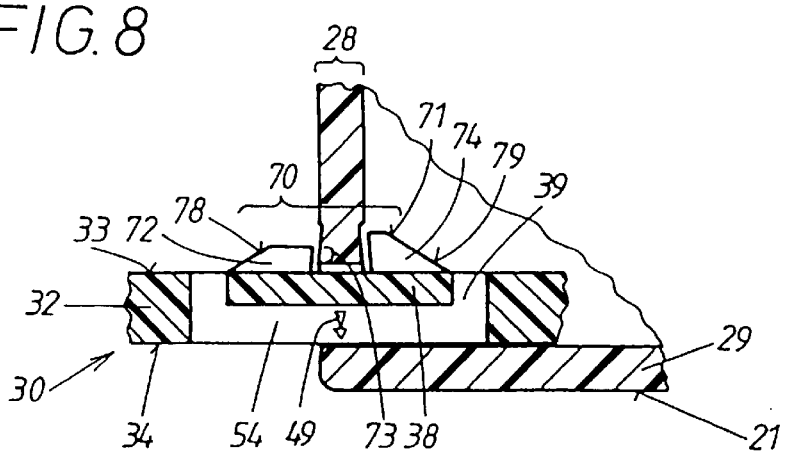
FIG. 8 shows, in greatly enlarged representation, a horizontal section VIII—VIII of FIG. 7 through a detail of the slide and of the socket housing.

As is apparent from FIGS. 4, 6 and 8, the aforementioned latch fastening 70 comprises two latch projections 71, 72, which are seated on a radially resilient tongue 38 which can best be discerned from FIG. 5. These latch projections 71, 72 thus form resiliently ductile latch elements. In this illustrative embodiment, an essentially rigid mating latch rib 73 of FIG. 8 is formed by a housing wall 28 of the socket housing 21. The resilient tongue 38 is produced by a U-shaped cutout 39 in the respective bow leg 32. As shown by FIGS. 4 and 6, the two latch projections 71, 72 are here located on the inner face 33 of the respective leg 32. They rise up over this inner face according to FIG. 8, whilst, in the direction of the outer face 34, there is a free space 54 which is discernible from FIG. 8.

In the fitting of the slide 30 in the socket housing 21, which fitting has already been described in connection with FIG. 5, it is advisable to provide an oblique ramp 79 on the inner latch projection 71. As the fitting 13 progresses, the preliminary latch rib 71 is then forced away from the edge of the housing wall 28, since the tongue 38 springs in the direction of the arrow 49 of FIG. 8 into the free space 54. The inner face of that side wall 29 of the socket housing which is depicted in fragmented representation in FIG. 7 and is represented in FIG. 8 herein serves to guide the slide 30 on the outer face 34 of its bow leg 32. The side wall 29 delimits the above-described free space 54 behind the resilient tongue 38.

Figure 12:
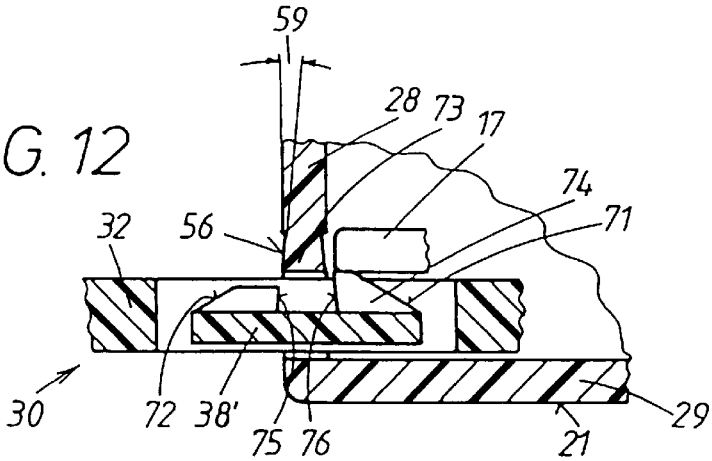
FIG. 12 shows, in an enlarged horizontal section according to FIG. 8, the same detail of the slide and of the socket housing in a different position, in which a latch fastening is disabled.

In the preliminary latch setting according to FIGS. 7 and 8, the mating latch rib 73 reaches between the two latch projections 71, 72 and thereby determines the aforementioned release setting of the slide 30 in the socket housing 21. This mating latch rib 73 is most easily produced by a wall edge of the aforementioned housing wall 28, which wall edge, according to FIG. 8, is undercut somewhat and delimits the abovementioned inlet opening 27 of the socket housing 21 in the receiving fixture 26, which inlet opening is visible in FIG. 1 in the bottom diagram. As is apparent from FIG. 12, the undercut 56 is configured on both face sides of the housing wall 28. The angle 59 of this undercut measures about 5°. In the case of the associated latch projections 71, 72, undercut flanks 75, 76 which are complementary thereto are obtained.

The inner latch projection 71 is provided with an axially climbing run-up slope 74, which can interact with a boss 17 provided on the plug housing 11. This can be seen from FIG. 3. If a gentle axial force is applied in the above-described plug-in motion 14 of the plug housing 11, then the boss 17 travels onto the run-up slope 74 and forces the tongue 38, in the direction of the arrows 49 discernible from FIG. 8, resiliently into the aforementioned free space 54. The tongue 38 is bent away. This position 381 of the tongue is portrayed in FIG. 12. The outer latch projection 72 is consequently also pivoted away in relation to the mating latch rib 73 on the housing wall 28 and releases the latch fastening 70. The slide 30 can now further be tilted in the direction of the aforementioned thrust 15 as indicated in FIG. 9. The actuation 15 of the slide 30 for the tilt motion 40 is thereby facilitated, although in this instance a positive-locking latch fastening according to FIG. 8 is established. This measure for disabling the latch fastening 70 acquires an independent, inventive importance.

Figure 13:
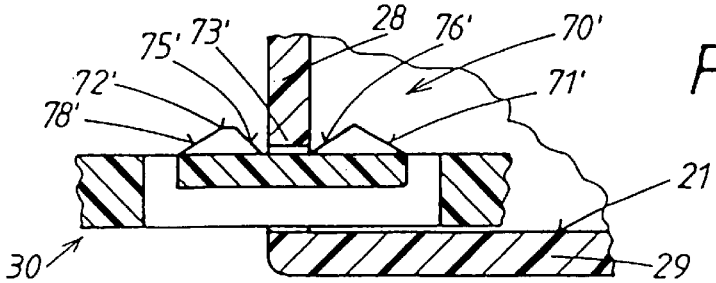
FIG. 13 shows, in a representation according to FIG. 8, an alternative design of the detail.

Alternatively, the latch fastening could also have a construction which can be seen from FIG. 13. FIG. 13 depicts that actively working latch fastening of the slide 30 which is visible in FIG. 8. The dual-sided flanks 75', 76' of the two latch projections 71', 72' ensure a non-positive detention of the wall edge 73'. In this instance, the above-described undercuts 56 are relinquished. A non-positive latch fastening 70' is established. The above-described disablement of this latch fastening 70' by means of the boss 17 belonging to the plug housing 11 can also be relinquished.

Upon the onward motion of the slide 30 in the direction of the thrust 15, the end position which is visible in FIG. 10 is finally attained, namely the described lock setting. This lock setting too can be secured by a latch fastening. For this purpose, the slide possesses at least on the inner face 33 of its one bow leg 32 a latch rib 77 which is visible in FIG. 6 and likewise interacts with the wall edge 73 of the housing wall 28 in the region of the lateral inlet opening 27. Between the latch rib 77 and the crown bar 31 of the slide 30 there remains a clearance 64, into which the housing wall 28 snaps as it passes into its lock setting which is visible in FIG. 10. This results in a temporary deformation in the region of the latch rib 77. As FIG. 10 shows, that lock setting of the slide 10 which is shown in FIG. 10 is also therefore latch-secured relative to the socket housing 21.

In the further course of the coupling motion 40 induced by the tilt-moved slide 30, the boss 17 of the plug housing 11 travels over the inner latch projection 71 and finally reaches the lower end position, visible in FIG. 10, inside the socket housing 21. In the decoupling operation 40', a deformation initially comes about in the region of the latch rib 77 whenever the slide, in counter-direction to the aforementioned thrust 15, is actuated by means of a pull-out force 15'. Via the intermediate position of FIG. 9, the preliminary latch setting of FIGS. 7 and 8 is finally attained. As can be discerned from FIG. 8, the outer latch projection 72 possesses namely an oblique ramp 78, which lies opposite the undercut flank 71 previously described. The slide 30 is thereby arrested in its release setting visible in FIG. 8. This applies analogously also to the described alternative configuration of the latch fastening 70' of FIG. 13, in which the outer latch projection 72' possesses a corresponding oblique ramp 78'.

Figure 11:
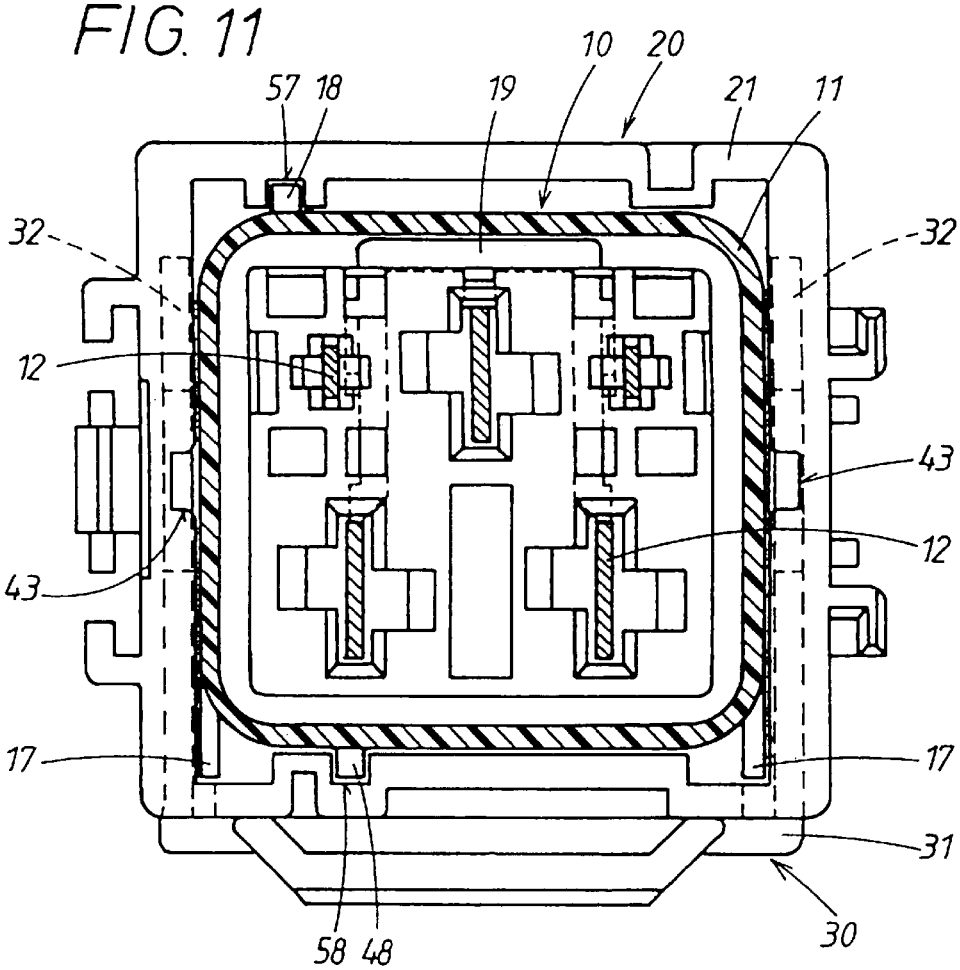
FIG. 11 shows a horizontal section through the two coupled connecting parts along the sectional line XI—XI of FIG. 10.

As illustrated by FIG. 3, the plug housing 11 is provided in the peripheral region with code ribs 18, 48, to which there are assigned, in the socket housing 21, code grooves 57 and 58 respectively in the receiving fixture 26 of the socket housing 21. The assignment of defined relays 10 to associated relay carriers 20 is thereby guaranteed and the possibility of a mix-up precluded. This can be seen from the coupling position of the two connecting parts 10, 20 in FIG. 11.

In order to be able to distinguish between different variants of relays 10 and relay carriers 20, the code ribs 18, 48 can be disposed in different alternative positions 18' and 48' represented in dash-dot representation in FIG. 3. The associated code grooves 57, 58 are in this case placed correspondingly in the associated socket housing 21. This coding ensures that the plug housing 11 can be inserted into the socket housing 21 only in a specific rotary orientation in the direction of the plug-in arrow 14 of FIG. 7 and that the bosses 17 are able to perform their previously described function.

Reference symbol list:

| | |
|---|---|
| 10 | connecting part, relay |
| 11 | plug housing of 10 |
| 12 | electrical mating contact in 11 |
| 13 | insertion arrow of 30 into 21 (FIG. 5) |
| 14 | plug-in arrow of 11 into 21 (FIG. 7) |
| 15 | thrust for 30 (FIGS. 7, 9, 10) |
| 15' | pull-out force for 30 (FIG. 10) |
| 16 | unit made up of 30, 11 |
| 17 | boss on 11 (FIG. 3) |
| 18 | code rib on 11 (FIG. 3) |
| 18' | alternative position of 18 (FIG. 3) |
| 19 | comb in end position (FIG. 2) |
| 19' | comb in preliminary latch position (FIG. 2) |
| 20 | connecting part, relay carrier |

-continued

Reference symbol list:

| | |
|---|---|
| 21 | socket housing of 20 |
| 22 | electrical contact in 21 (FIG. 1) |
| 23 | core piece of 21 |
| 24 | axial chamber in 23 |
| 25 | electric lead for 22 |
| 26 | annular receiving fixture in 21 |
| 27 | lateral inlet opening in 26 (FIG. 1) |
| 28 | housing wall for 73 (FIG. 8) |
| 29 | housing side wall of 21 (FIG. 8) |
| 30 | slide (in release setting) |
| 30' | slide (in lock setting) |
| 31 | U-crown bar of 30 |
| 32 | bow leg of 30 |
| 33 | inner face of 32 |
| 34 | outer face of 32 |
| 35 | pivot motion of 30 (FIG. 7) |
| 36 | lever arm of 30 |
| 37 | pivot angle at 35 (FIG. 7) |
| 38 | tongue for 70 (in rest position) |
| 38' | bent-away position of 38 (FIG. 12) |
| 39 | U-shaped cutout in 32 for 38 (FIG. 5) |
| 40 | arrow of the coupling motion (FIG. 7) |
| 40' | arrow of the decoupling motion (FIG. 10) |
| 41 | coupling journal |
| 41' | coupling journal in coupling end position (FIGS. 7, 10) |
| 41" | coupling journal prior to the insertion (FIG. 7) |
| 42 | arc-shaped coupling channel |
| 43 | axial insertion opening in 21 for 41 |
| 44 | channel opening, free end of 42 |
| 45 | total axial stroke of 11 in relation to 20 |
| 46 | part-stroke of 45 |
| 47 | residual stroke of 45 |
| 48 | code rib on 11 (FIG. 3) |
| 48' | alternative position of 48 (FIG. 3) |
| 49 | countersinking arrow of 38 into 54 (FIG. 8) |
| 50 | axial control mechanism |
| 51 | bearing cam on 30 |
| 51' | end position on 51 (FIG. 7) |
| 52 | axial groove for 51 in 21 |
| 53 | pivot bearing between 51, 52 |
| 54 | free space behind 38 (FIG. 8) |
| 55 | translation motion of 10, 30 |
| 56 | undercut at 73 (FIG. 12) |
| 57 | code groove for 17 in 21 (FIG. 2) |
| 58 | code groove for 48 in 21 (FIG. 2) |
| 59 | undercut angle (FIG. 12) |
| 60 | tilt control mechanism |
| 61 | sliding block for 60 |
| 62 | sliding block guide of 60 |
| 64 | clearance between 31, 71 (FIG. 6) |
| 70, 70' | latch fastening (FIGS. 8, 13) |
| 71, 71' | inner latch projection of 70 (FIGS. 8, 13) |
| 72, 72' | outer latch projection of 70 (FIGS. 8, 13) |
| 73, 73' | mating latch rib of 70, wall edge of 28 (FIGS. 8, 13) |
| 74 | run-up slope of 71 (FIG. 6) |
| 75, 75' | undercut flank of 71 and 71' |
| 76, 76' | undercut flank of 72 and 72' |
| 77 | latch rib on 33 (FIG. 6) |
| 78, 78' | oblique ramp on 72 (FIGS. 8, 13) |
| 79 | oblique ramp on 71 (FIG. 8) |

We claim:

1. An electrical plug-and-socket connection comprising two detachable connecting parts (10, 20), and further including a laterally extensible slide (30) secured to one of the connecting parts and constructed and arranged to axially couple together (40) and decouple (40') the two detachable connecting parts so that in a connector coupled position the connecting parts are locked together and wherein one of the connecting parts includes a socket housing (21) with electrical contacts (22) fitted therein and the socket housing (21) including a lateral receiving fixture (26) with control means for the slide (30), while the other connecting part (10) includes a complementary plug housing (11) axially guide-able in the socket housing (21), the plug housing having electrical mating contacts (12) fitted in said plug housing and having at least one laterally protruding coupling journal (41), and the slide (30) having a profiled coupling channel (42) for receiving the coupling journal (41) of the plug housing (11) and for movement of the slide between a connector coupled position and a connector decoupled position, and so that in the connector decoupled position the plug housing (11) can be axially inserted and withdrawn (14) by the coupling journal (41) into and from the open end (44) of the coupling channel (42) of the slide (30), and, in the connector coupled position the plug housing (11) is in a retracted locked position in the socket housing (21), the contacts (22) are electrically connected to the mating contacts (11) and the coupling journal (41) is axially overlapped by the coupling channel (42), wherein between the slide (30) and the socket housing (21) there are disposed two different control means (50, 60), which determine a translatory (55) pivot motion (35) of the slide (30) in the socket housing (21), the first control means forming an axial control mechanism (50) having an essentially linear axial groove (52) on the socket housing (21) and a radial bearing cam (51) on the slide (30), which, in addition to its translation motion (55) in the axial groove (52), simultaneously determines the pivot bearing (53) for the pivot motion (35) of the slide (30), and the second control means forming a tilt control mechanism (60) having control parts configured, as a sliding block (61) and, as a sliding block guide (62), the sliding block guide (62) being curved according to the combined pivot-translation motion (35, 55) of the slide (30), and wherein the coupling channel (42) is an arc segment, which essentially solely determines the lever-like pivot motion (35) of the slide (30) and which is disposed in relation to the pivot bearing (53) of the slide on the same lever arm side (36) as the tilt control mechanism (60) of said slide and the axial arc height of which determines only a part-stroke (46) of the coupling and decoupling motions (40, 40') between the plug housing (11) and the socket housing (21), wherein the plug housing (11), by virtue of its coupling journal (41) reaching into the arc segment (42), forms together with the slide a unit (16) which is movable in translation motion within the socket housing and which allows an axial residual stroke (47) for the coupling and decoupling of the connector parts.

2. The plug-and-socket connection as claimed in claim 1, wherein the slide (30) is configured in the shape of a U-bow and includes a U-crown bar (31) that serves as the actuation (15) of the slide, and further comprising two bow legs (32) that possess on their inner faces (33) both two mutually opposing, arc-shaped coupling channels (42) for two coupling journals (41) located on opposite side faces of the plug housing (11) and two bearing cams (51) of the axial control mechanism (50), while on the outer faces (34) of the two bow legs (32) there are disposed the one control parts (62) of two mutually opposing tilt control mechanisms (60), while their two other control parts (61) are located on the socket housing (21).

3. The plug-and-socket connection as claimed in claim 1 wherein the sliding block (61) of the tilt control mechanism (60) is disposed in fixed position in the socket housing (21), while the associated sliding block guide (62) is located on the slide (30).

4. The plug-and-socket connection as claimed in claim 1 wherein, on the slide (30), the control parts (62) belonging to the tilt control mechanism (60) are disposed closer to that bearing cam (51) of the axial control mechanism (50) which determines the pivot bearing (53) than is the arc-shaped coupling channel (42) in the slide (30), which serves the reception of the coupling journal (41) of the plug housing (11).

5. The plug-and-socket connection as claimed in claim 1 wherein the release setting of the slide (30) in the socket housing (21) is fixed by a fastening latch (70).

6. The plug-and-socket connection as claimed in claim 5, wherein two latch projections (71, 72) of the fastening latch (70) are seated on a radially resilient tongue (38) of the slide (30) and form resiliently ductile latch elements, while an essentially rigid mating latch rib (73), which travels in a release setting between the two latch projections (71, 72), is located on the socket housing (21).

7. The plug-and-socket connection as claimed in claim 6, wherein the resilient tongue (38) is produced by a cutout (39) in a bow leg (32) of the U-shaped slide (30).

8. The plug-and-socket connection as claimed in claim 6 wherein the two bow legs (32) of the U-shaped slide (30) have on their outer face (34) a free space (54) for the tongue (38), into which the tongue (38) springs during the latch transfer.

9. The plug-and-socket connection as claimed in claim 6 wherein one of the latch projections (71) on the tongue (38) includes an axial run-up slope (74) for a boss (17) located on the plug housing (11), and the boss (17), upon an axial coupling motion (40) of the plug housing (11), slides onto the run-up slope (74) and forces the tongue (38) radially away to the point where the outer latch projection (72) also releases the mating latch rib (73) located on the socket housing (21).

10. The plug-and-socket connection as claimed in claim 11 wherein the slide (30) in the shape of a U-bow has a latch element (77) on at least one of its two bow legs (32), which latch element, in the connector coupled position of the slide, interacts with the mating latch rib (73), which, in the connector decoupled position of the slide, constitutes a component part of the latch fastening (70).

* * * * *